United States Patent [19]

Ganaway

[11] Patent Number: 4,761,839

[45] Date of Patent: Aug. 9, 1988

[54] SINK SPRAY AND AUXILIARY ATTACHMENT DEVICE

[76] Inventor: Richard M. Ganaway, 1845 S. Highland, Bldg. 11, Apt. 3, Clearwater, Fla. 33516

[21] Appl. No.: 931,091

[22] Filed: Nov. 17, 1986

[51] Int. Cl.[4] ..... E03C 1/02

[52] U.S. Cl. ..... 4/654; 4/191; 239/289; 239/579; 251/352

[58] Field of Search ..... 4/191, 192, 654; 251/352; 137/616, 616.5; 239/289-292, 579, 588

[56] References Cited

U.S. PATENT DOCUMENTS

| | | | |
|---|---|---|---|
| 674,696 | 5/1901 | Gardenier | 137/616 |
| 759,246 | 5/1904 | Delany | 137/616.5 |
| 2,590,353 | 3/1952 | Schaar et al. | 239/289 X |
| 2,755,652 | 7/1956 | Shelton et al. | 251/352 X |
| 3,131,868 | 5/1964 | Coleman | 239/390 X |
| 3,610,280 | 10/1971 | Kitamura | 137/616.5 |

*Primary Examiner*—Charles E. Phillips
*Attorney, Agent, or Firm*—Herbert W. Larson

[57] ABSTRACT

A multipurpose sink spray device having an upstream and downstream stem integrally joined to a valve housing containing a two-way valve. A slot in the valve housing receives a locking tab mounted in an annular opening of an auxiliary attachment device such as a spigot or a brush. Movement of the locking tab in the slot activates a valve in the housing and allows water to flow through the attachment device. Alternatively, the sink spray device can be activated without the auxiliary attachment device by depressing a lever or handle on the sink spray housing.

7 Claims, 5 Drawing Sheets

SINK SPRAY AND AUXILIARY ATTACHMENT DEVICE

BACKGROUND OF THE INVENTION

1. Field of the Invention

This invention relates to a sink spray. More particularly, it refers to a sink spray capable of engaging multiple attachment devices to vary the utility of the sink spray.

2. Description of the Prior Art

Sink sprays are well known products and are currently found as a fixture in most private houses, apartments and commercial kitchen facilities. Typical sink sprays are described in U.S. Pat. Nos. 3,498,546; 4,148,438; and 4,344,578. Such sprays are adapted for one use; namely, portability for directed discharge of water at the end of a limited length hose. Because space is restricted on a sink and plumbing codes frequently limit fixtures on a sink, the single purpose use of a sink spray is inconvenient.

When a below sink filter system is employed it could be hooked up to the sink spray but this eliminates the spray from use as a utility device to clean pots and pans. Moreover, the spray nozzole on the sink spray is not a convenient device for filling a glass or other drinking container. A way is needed to easily convert a sink spray into a multitude of uses.

SUMMARY OF THE INVENTION

I have invented a sink spray that can be easily mated to various utilitarian devices useful on a sink.

My apparatus mates a sink spray device with a spigot for use when the water circulation system feeds through a below the sink water filter device. Alternatively, a brush can be mated to the sink spray to provide means for cleaning pots, bottles and pans using both the abrasive power of the brush and the concentrated water pressure from the spray device.

The sink spray unit contains an annular hose connector attached to a sink's standard flexible conduit. The annular hose connector is in turn attached to a three component housing containing a two-way valve and means for rotatably attaching the valve housing to the attachments. The attachment can be a spigot which causes water to flow when a locking tab in an annular opening to the spigot engages a slot in the sink spray housing and actuates a valve to permit water flow. Alternatively, a brush attachment to the sink spray with the locking tab in its annular opening merely acts to seat the brush on the sink spray. The handle on the sink spray is used to actuate the valve in the sink spray housing to allow water to flow through the brush attachment.

The sink spray consists of three integral parts; namely, an upstream housing, a valve housing and a downstream housing. The upstream housing is connected to a flexible hose from a water source, the valve housing contains the two way valve controlling water flow and the slot for receiving the locking tab from the auxiliary attachments. The downstream housing mates with the interior of each attachment device.

BRIEF DESCRIPTION OF THE DRAWINGS

The present invention may be best understood by those having ordinary skill in the art by reference to the following detailed description when considered in conjunction with the accompanying drawings in which.

FIG. IO is a diagramatic view of the water flow system going through a filter element below the sink.

Figure 3:
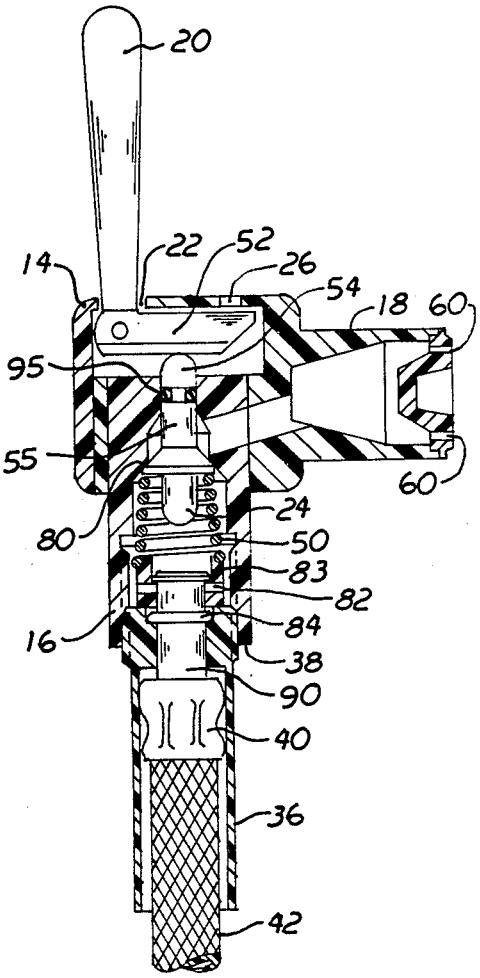
FIG. 3 is an elevation view in partial section of the sink spray in a non-operating mode.
Figure 11:
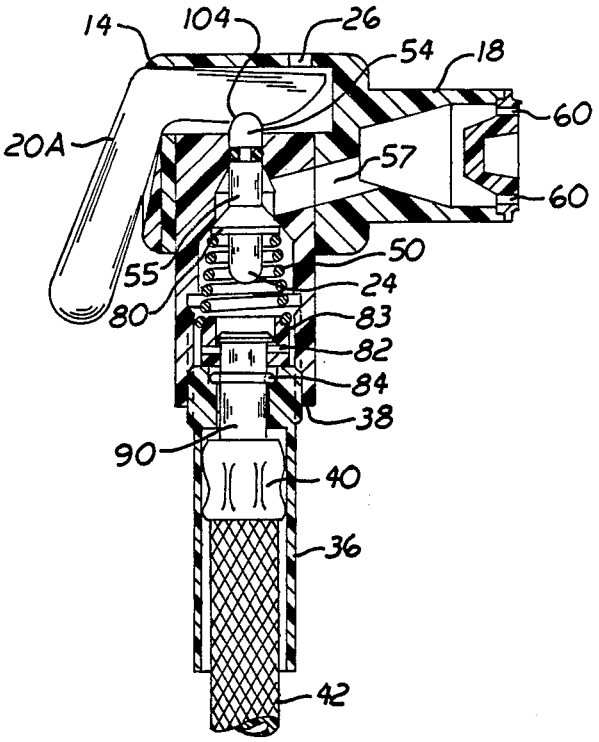

FIG. 11 is an elevational view in section of an alternate sink spray from the one shown in FIG. 3.

Figure 12:
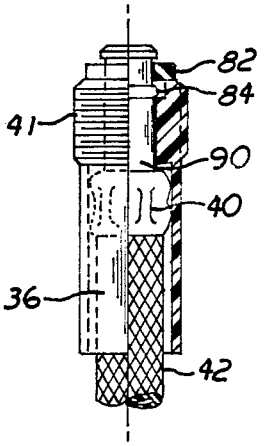

FIG. 12 is a detailed elevation view partially in section of the annular hose connector.

DETAILED DESCRIPTION OF THE INVENTION

Throughout the following detailed description the same reference numerals refer to the same elements in all figures.

The apparatus of this invention combines a sink spray 10 with at least two alternate attachments 12 or l2A.

Figure 1:
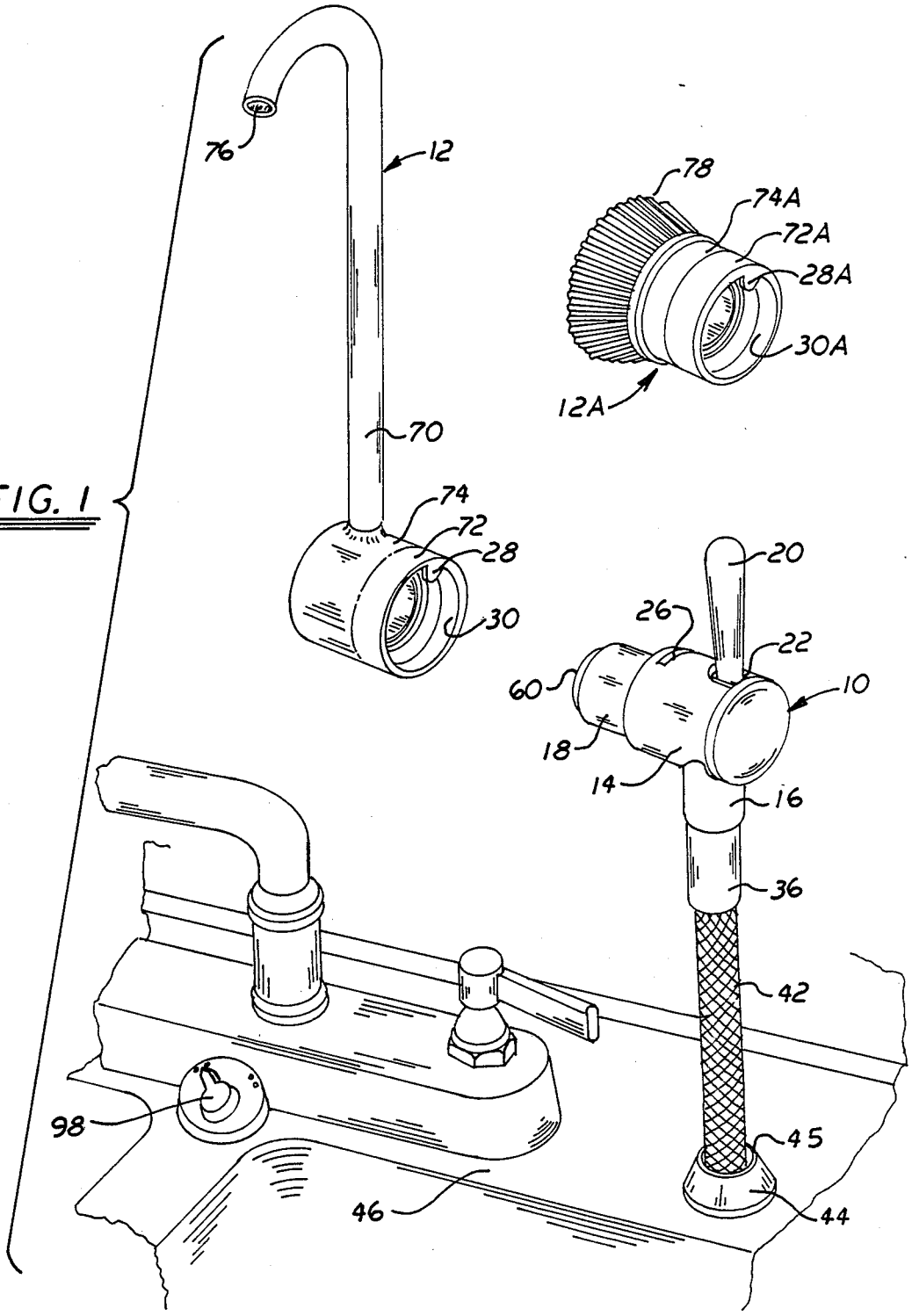
FIG. 1 is a perspective view of the sink spray and its attachments in relation to a sink.
Figure 2:
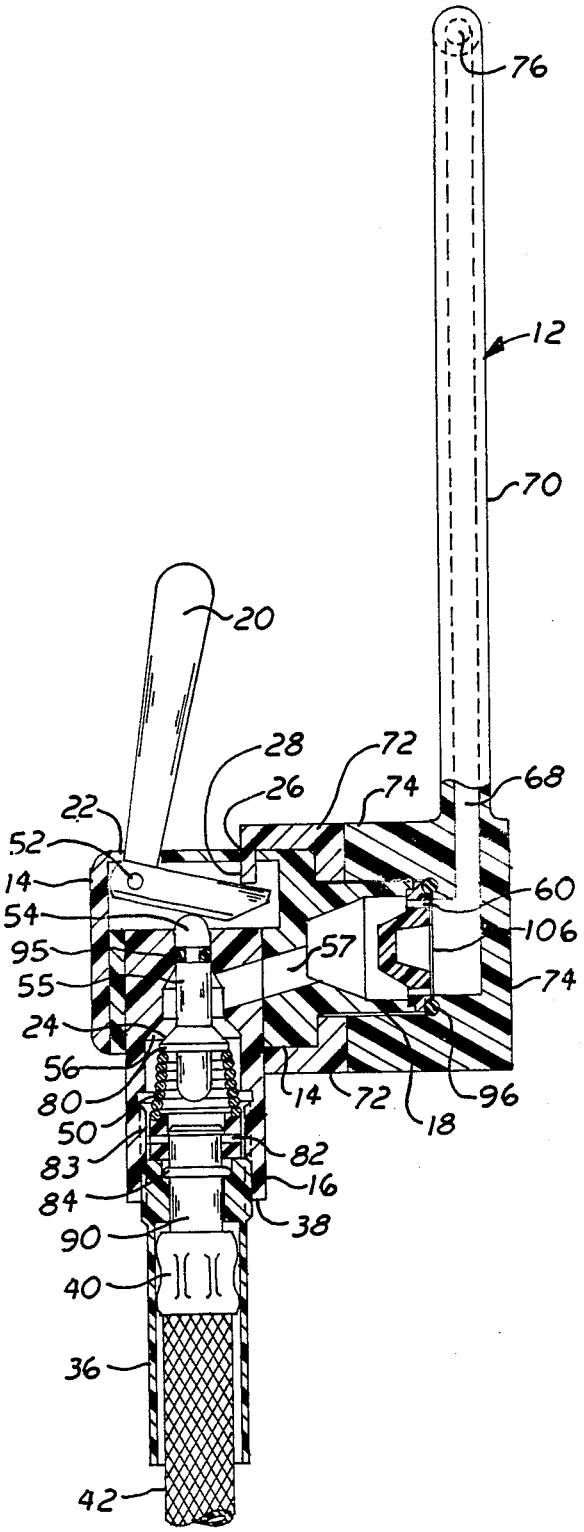
FIG. 2 is an elevation view in partial section of the sink spray and spigot attachment in an operational mode.

The sink spray 10 is generally cylindrical in shape and can be conveniently made from injection molded high density polymer materials such as DuPont DELRIN® or Celanese CELCON®. Three basic parts of the spray housing include the valve housing 14, an integral cylindrical upstream stem 16 and an integral cylindrical downstream stem 18. The valve housing 14 has an actuating lever 20 (FIGS. 2–3) inserted through an opening 22 to the interior of valve housing 14 where it is capable of actuating a valve 24. Alternatively, the actuating lever can be a grip 20A with groove 104 (FIG. 11) engaging the top 54 of valve 24.

Figure 4:
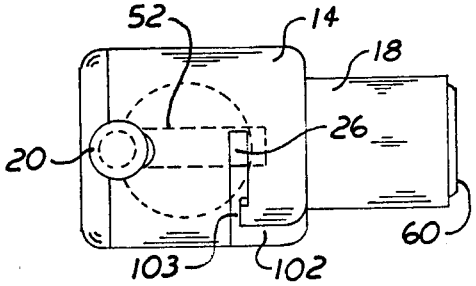
FIG. 4 is a plan view of the sink spray.

The valve housing 14 has a lock tab slot 26 which accommodates a locking tab 28 or 28A from the inlet end 30 or 30A of the attachment 12 or 12A. Movement of the locking tab 28 or 28A through entrance groove 102, past notch 103 (FIG. 4) places it in a first position 32. When tab 28 or 28A is moved to a second position 34 it opens valve 24. See FIGS. 7 and 8.

The attachment 12 has an inverted J-tube 70 leading from a cylindrical body 74 integral with an annular member 72. Annular member 72 receives horizontal stem 18 from sink spray 10. Water flowing into attachment 12 exits at opening 76. Attachment l2A has cylindrical body 74A integral with annular member 72A. Annular member 72A receives horizontal stem 18 from sink spray 10. Brushes 78 are integral with body 74A.

The vertical stem 16 of the sink spray 10 is threaded at its upstream end to an annular hose connector 36. The annular hose connector 36 separates the vertical stem 16 from the flexible water conduit 42 which in turn is attached to a water supply. This conduit 42 provides the means for the water supply to reach the sink spray 10. The standard features of the hose parts including flexible hose 42, metal hose connector 40 and its nylon bushing 90 are connected over the downstream end of connector 36 by insertion of a metal snap ring 84. A washer 82 downstream from ring 84 prevents leakage at this connection. The downstream end of connector 36 has male threads 41 which engage the upstream threads on the inner surface of vertical stem 16.

For purposes of this specification the water source in the sink piping 68 is the furthest upstream point and the water outlet 76 is the furthest downstream point.

The flexible water conduit 42 moves up and down through receptacle 44 attached to sink 46. Its lowest position is determined by the upstream edge 38 of the vertical stem 16 which rests on the top surface 45 of the receptacle 44. The flexible water conduit 42 can be connected to any water supply source containing potable water.

Valve 24 is normally in the closed position because of the action of spring 50 held in place by retainer 83. Seal 80 prevents leakage of water. See FIG. 3. Movement of lever 20 in a direction towards the horizontal stem 18 causes an actuating member 52 attached to the lever 20 to press down on the downstream nipple 54 of valve 24. In like manner, squeezing of handle 20A causes pressure to be exerted on nipple 54. This causes the valve 24 to be depressed against its spring 50 and opens chamber 56 to allow the flow of water from hose 42. See FIGS. 2 and 9.

When the sink spray 10 is disconnected from an accessory device 12 or 12A, actuation of lever 20 or handle 20A causes water to spray from nozzle end 60. When in the upright position, lever 20, as shown in FIG. 3, has no action on valve 24 and consequently no water flows through the sink spray 10.

Upon insertion of the horizontal stem 18 into inlet 30 or 30A and fully seating it by inserting tab 28 or 28A into entrance groove 102, the system is ready for operation.

Figure 7:
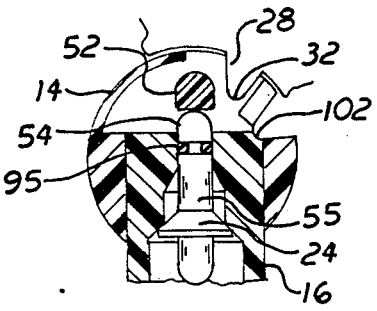
FIG. 7 is a detailed sectional view of the sink spray two way valve closed and the valve housing exterior surface features when the apparatus is in the FIG. 5 non-operating mode.
Figure 8:
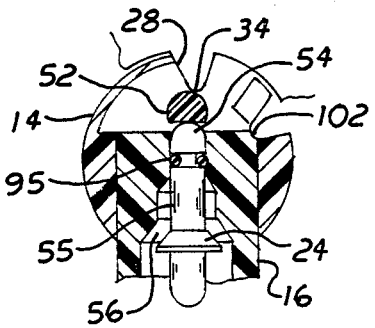
FIG. 8 is a detailed sectional view of the sink spray two way valve open and the valve housing exterior surface features when the apparatus is operating according to FIG. 6.

The mechanism for allowing the flow of water to move from conduit 42 when the accessory 12 or 12A is in place is not lever 20 or 20A but locking tab 28 or 28A which moves from a first position 32 as shown in FIG. 7 to a second position 34 as shown in FIG. 8. In position 34 the tab 28 depresses the actuating member 52 and causes valve 24 to be pressed against its spring 50 and thereby opens channel 56 to allow the flow of water.

Figure 5:
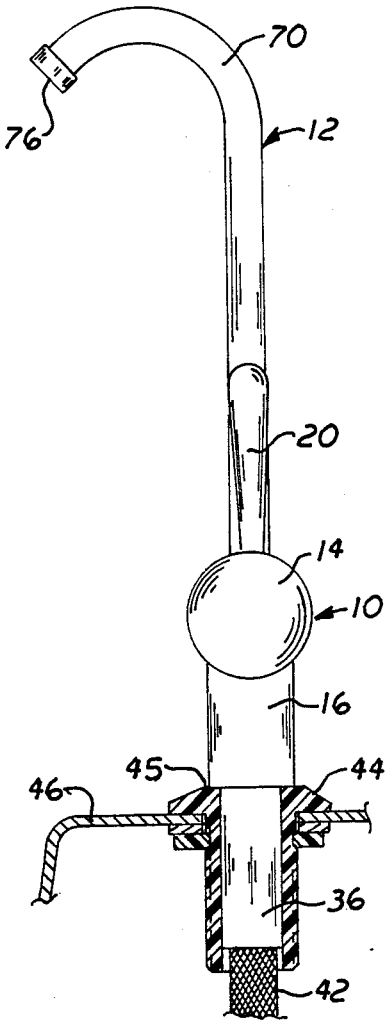
FIG. 5 is a side elevation view partially in section showing the sink spray and spigot attachment in a non-operating mode.
Figure 6:
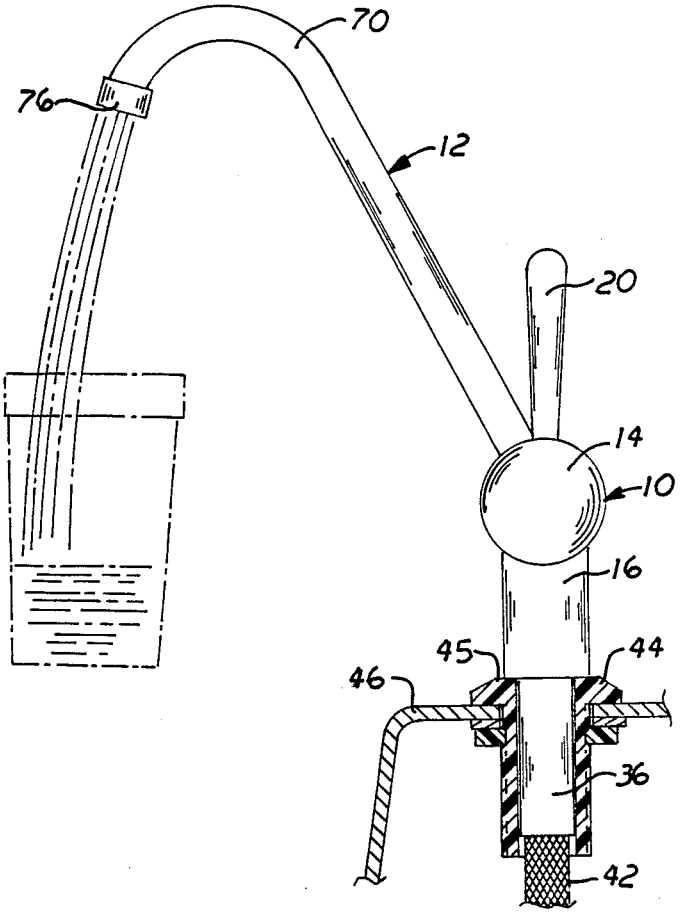
FIG. 6 is a side elevation view partially in section showing the sink spray and spigot attachment in an operating mode.

FIG. 5 shows the sink spray 10 and spigot 12 in a resting position and FIG. 6 shows the spigot 12 pulled down about 30 degrees to actuate valve 24 in the sink spray 10 and permit water to flow through channels 56 and 57 through porous material 106, and channel 68 to outlet 76.

Figure 9:
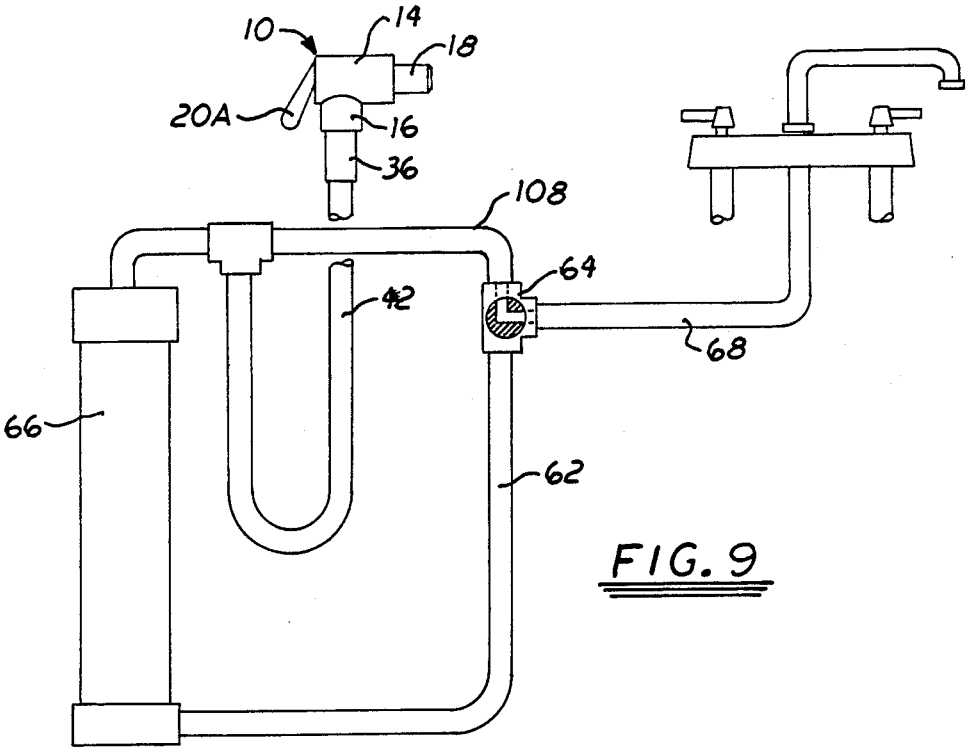
FIG. 9 is a diagramatic view of the water flow system going through or by-passing the filter element below the sink.
Figure 10:
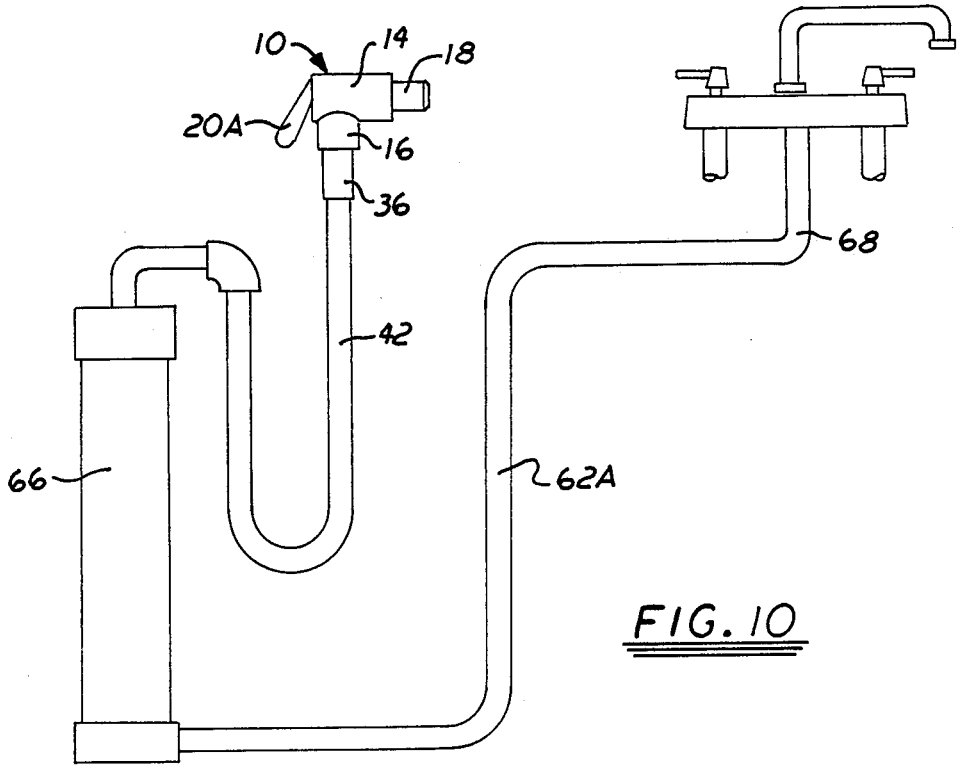

The large filter container 66 as shown in FIGS. 9 and 10 is designed to be installed below the sink to provide filtered water through spigot 12. A switch 98 on sink 46 changes the flow through valve 64 so that the water flows through piping 62, through filter 66 and eventually out through outlet 76. If the sink spray alone is to be used without the filtering cycle, the switch 98 is turned so that water flows through piping 108 directly to the sink spray. See FIG. 9. A simple piping diagram with water flow from its source piping 68 through piping 62A to filter 66 is shown in FIG. 10.

Lock ring 84 holds the hose connection in place downstream from the annular hose connector 36 as seen in FIG. 12. Nylon bushing 90 contains a groove for holding the lock ring 84. A standard hose fitting 40 is connected to nylon bushing 90 to make the water connection.

O-rings 96 in the horizontal stem 18 prevent leakage of water.

The auxiliary attachment devices can be molded from the same or different polymer materials used to make the sink spray housing.

The filter cartridge can contain activated charcoal, coral sand, ion exchange resins or other filter media. The water filter container 66 can also contain additive ingredients downstream of the filter such as calcium or magnesium to add desirable minerals to the water. Various flavorings can be added to the water outlet 76 so that the water runs through the flavoring and gives added taste to the water.

Equivalent valves and mechanisms can be substituted for the various valves and mechanisms of the present invention without departing from its scope.

Having thus described the invention, what is claimed and desired to be secured by Letters Patent is:

1. A combination sink spray device and auxiliary attachment device comprising:

(a) a sink spray housing having an upstream stem and downstream stem integrally connected to a valve housing containing internally a valve for controlling the flow of water through the housing;

(b) an annular opening at an entrance to an interior channel of the upstream stem for receiving water in the upstream stem and an annular opening at an exit from an interior channel of the downstream stem for discharging water from the downstream stem;

(c) a slot on an exterior surface of the valve housing and the downstream stem inserted into an interior cylindrical channel of the auxiliary attachment device, the interior cylindrical channel having an interior wall;

(d) a locking tab integral with the interior wall in the auxiliary attachment device and projecting from the wall towards a center of the channel;

(e) the locking tab capable of being inserted into an entrance groove leading to the slot of the valve housing to seat the auxiliary attachment device; and (f) the locking tab capable of moving from a first engaging position to a second engaging position in the slot to open the valve within the sink spray housing.

2. The combination device according to claim 1 wherein the auxiliary attachment device is an inverted J-spigot.

3. The combination device according to claim 1 wherein the auxiliary attachment device is a brush integral with a cylindrical housing.

4. The combination device according to claim 1 wherein the sink spray is attached to a flexible hose at its upstream stem by an annular hose connector having a narrower diameter than the upstream stem.

5. The combination device according to claim 1 wherein the valve in the housing is a two way valve.

6. The combination device according to claim 1 wherein the upstream stem is in a vertical plane and the downstream stem in a horizontal plane in relation to the valve housing.

7. The combination device according to claim 1 wherein the sink spray housing and auxiliary attachments device is made from a high density polymer.

* * * * *